US006997777B2

(12) United States Patent
Newell

(10) Patent No.: US 6,997,777 B2
(45) Date of Patent: Feb. 14, 2006

(54) ULTRASONIC WELDING METHOD FOR THE MANUFACTURE OF A POLISHING PAD COMPRISING AN OPTICALLY TRANSMISSIVE REGION

(75) Inventor: Kelly J. Newell, St. Charles, IL (US)

(73) Assignee: Cabot Microelectronics Corporation, Aurora, IL (US)

( * ) Notice: Subject to any disclaimer, the term of this patent is extended or adjusted under 35 U.S.C. 154(b) by 0 days.

(21) Appl. No.: 10/463,721

(22) Filed: Jun. 17, 2003

(65) Prior Publication Data

US 2004/0259483 A1 Dec. 23, 2004

(51) Int. Cl.
*B24B 49/00* (2006.01)

(52) U.S. Cl. ..... 451/6; 451/56; 451/548

(58) Field of Classification Search ..... 451/5, 451/8, 6, 41, 56, 59, 526, 527, 533, 548
See application file for complete search history.

(56) References Cited

U.S. PATENT DOCUMENTS

| | | | | |
|---|---|---|---|---|
| 5,605,760 | A | 2/1997 | Roberts | |
| 5,846,377 | A | 12/1998 | Frantz et al. | |
| 5,855,706 | A | 1/1999 | Grewell | |
| 5,893,796 | A | 4/1999 | Birang et al. | |
| 6,120,352 | A | 9/2000 | Duescher | |
| 6,171,181 | B1 | 1/2001 | Roberts et al. | |
| 6,231,434 | B1 * | 5/2001 | Cook et al. | 451/527 |
| 6,254,459 | B1 * | 7/2001 | Bajaj et al. | 451/41 |
| 2003/0180973 | A1 * | 9/2003 | Lehman et al. | 438/14 |

FOREIGN PATENT DOCUMENTS

| | | |
|---|---|---|
| EP | 1 038 637 A2 | 9/2000 |
| EP | 1 112 816 A2 | 7/2001 |
| EP | 1176631 | 1/2002 |
| WO | WO 02/28613 A1 | 4/2002 |

OTHER PUBLICATIONS

"Ultrasonic Plastics Welding Basics", Jan. 2001, Welding Journal.*

* cited by examiner

*Primary Examiner*—M. Rachuba
(74) *Attorney, Agent, or Firm*—Caryn Borg-Breen

(57) ABSTRACT

A method of forming a chemical-mechanical polishing pad having at least one optically transmissive region comprising (i) providing a polishing pad comprising an aperture, (ii) inserting an optically transmissive window into the aperture of the polishing pad, and (iii) bonding the optically transmissive window to the polishing pad by ultrasonic welding.

18 Claims, 1 Drawing Sheet

ULTRASONIC WELDING METHOD FOR THE MANUFACTURE OF A POLISHING PAD COMPRISING AN OPTICALLY TRANSMISSIVE REGION

FIELD OF THE INVENTION

This invention pertains to a method of forming a polishing pad having one or more optically transmissive regions.

BACKGROUND OF THE INVENTION

Chemical-mechanical polishing ("CMP") processes are used in the manufacturing of microelectronic devices to form flat surfaces on semiconductor wafers, field emission displays, and many other microelectronic substrates. For example, the manufacture of semiconductor devices generally involves the formation of various process layers, selective removal or patterning of portions of those layers, and deposition of yet additional process layers above the surface of a semiconducting substrate to form a semiconductor wafer. The process layers can include, by way of example, insulation layers, gate oxide layers, conductive layers, and layers of metal or glass, etc. It is generally desirable in certain steps of the wafer process that the uppermost surface of the process layers be planar, i.e., flat, for the deposition of subsequent layers. CMP is used to planarize process layers wherein a deposited material, such as a conductive or insulating material, is polished to planarize the wafer for subsequent process steps.

In a typical CMP process, a wafer is mounted upside down on a carrier in a CMP tool. A force pushes the carrier and the wafer downward toward a polishing pad. The carrier and the wafer are rotated above the rotating polishing pad on the CMP tool's polishing table. A polishing composition (also referred to as a polishing slurry) generally is introduced between the rotating wafer and the rotating polishing pad during the polishing process. The polishing composition typically contains a chemical that interacts with or dissolves portions of the uppermost wafer layer(s) and an abrasive material that physically removes portions of the layer(s). The wafer and the polishing pad can be rotated in the same direction or in opposite directions, whichever is desirable for the particular polishing process being carried out. The carrier also can oscillate across the polishing pad on the polishing table.

In polishing the surface of a substrate, it is often advantageous to monitor the polishing process in situ. One method of monitoring the polishing process in situ involves the use of a polishing pad having an aperture or window. The aperture or window provides a portal through which light can pass to allow the inspection of the substrate surface during the polishing process. Polishing pads having apertures and windows are known and have been used to polish substrates, such as semiconductor devices. For example, U.S. Pat. No. 5,893,796 discloses removing a portion of a polishing pad to provide an aperture and placing a transparent polyurethane or quartz plug in the aperture to provide a transparent window. The transparent plug can be integrally molded into the polishing pad by (1) pouring liquid polyurethane into the aperture of the polishing pad and subsequently curing the liquid polyurethane to form a plug, or by (2) placing a preformed polyurethane plug into the molten polishing pad material and then curing the entire assembly. Alternatively, the transparent plug can be affixed in the aperture of the polishing pad through the use of an adhesive followed by curing of the adhesive over several days.

Similarly, U.S. Pat. No. 5,605,760 provides a pad having a transparent window formed from a solid, uniform polymer material that is cast as a rod or plug. The transparent plug can either be inserted into the aperture of an opaque polymeric polishing pad while the pad is still molten in a mold, or the window portion can be inserted into the aperture of a polishing pad using an adhesive.

Such prior art methods for affixing a window portion into a polishing pad have many disadvantages. For example, the use of adhesives is problematic insofar as the adhesives can have harsh fumes associated with them and often require curing over 24 hours or more. The adhesive in such polishing pad windows also can be subject to chemical attack from the components of the polishing composition and so the type of adhesive used in attaching the window to the pad has to be selected on the basis of what type of polishing system will be used. Furthermore, the bonding of the window portion to the polishing pad is sometimes imperfect or degrades over time such that leakage of the polishing composition between the pad and the window occurs. In some instances, the window portion can even become dislodged from the polishing pad over time.

The aforementioned problems can be overcome through the use of a one-piece polishing pad, in which either the entire polishing pad is transparent or the transparent window portion is prepared by specially modifying a small portion of an opaque polishing pad. For example, U.S. Pat. No. 6,171,181 discloses a polishing pad comprising a window portion that is a one-piece article formed by rapidly cooling a small section of the polishing pad mold to form a transparent amorphous material that is surrounded by a more crystalline and thus opaque polymer material. However, such a manufacturing method is costly, is limited to polishing pads that can be formed using a mold, and necessitates that the polishing pad material and the window material have the same polymer composition.

Thus, there remains a need for a method of producing polishing pads with optically transmissive regions that can be applied to a wide variety of polishing pad and window materials, which can form a stable, integral bond between the window and the pad that is not prone to leakage, and can be produced without sacrificing time- and cost-efficiency.

The invention provides such a method of producing polishing pads comprising optically transmissive regions. These and other advantages of the present invention, as well as additional inventive features, will be apparent from the description of the invention provided herein.

BRIEF SUMMARY OF THE INVENTION

The present invention provides a method for producing a polishing pad having at least one optically transmissive window comprising (i) providing a polishing pad with a body comprising an aperture, (ii) inserting an optically transmissive window into the aperture of the body of the polishing pad, and (iii) bonding the optically transmissive window to the body of the polishing pad by ultrasonic welding to form a polishing pad having the optically transmissive window.

DETAILED DESCRIPTION OF THE INVENTION

Figure 1A:
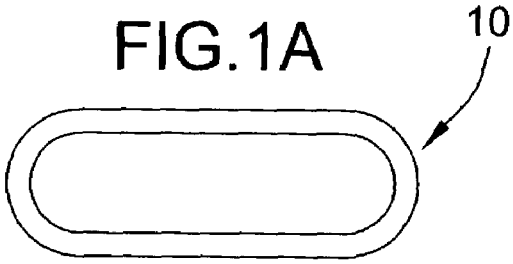
FIG. 1A depicts a top view of an oval-shaped optically transmissive window suitable for use in the ultrasonic welding method of the invention.

The invention is directed to a method of forming a chemical-mechanical polishing pad having at least one optically transmissive window. The method comprises the steps of (i) providing a polishing pad with a body comprising an aperture (e.g., hole or opening), (ii) inserting an optically transmissive window or lens into the aperture of the polishing pad, and (iii) bonding the optically transmissive window to the body of the polishing pad by ultrasonic welding.

Ultrasonic welding involves the use of high frequency sound waves to melt materials and cause the materials to flow together and form a mechanical bond. Typically, the source of ultrasonic waves is a sound-generating metal tuning device (e.g., a "horn") that converts a high-frequency electrical signal into sound, although any suitable source of ultrasonic sound can be used. The horn can be any suitable horn, for example, a stainless steel horn. The horn can have any suitable shape or configuration and preferably is machined to have a similar shape (or even an identical shape) to the shape of the polishing pad window.

The horn is placed against the region of the body of the polishing pad containing the aperture and the optically transmissive window that are to be welded together. An elevated pressure is applied to the horn that increases the pressure of the horn against the surface of the body of the polishing pad and optically transmissive window. The pressure is recorded as an actuator pressure and actuator velocity. The body of the polishing pad and optically transmissive window are held in place against the horn through the use of a fixture. The actuator pressure typically is about 0.05 MPa to about 0.7 MPa (e.g., about 0.1 MPa to about 0.55 MPa). Preferably, the actuator pressure is about 0.2 MPa to about 0.45 MPa. The actuator velocity typically is about 20 m/s to about 35 m/s (e.g., about 22 m/s to about 30 m/s). The actuator velocity preferably is about 28 m/s or higher when the optically transmissive window is a solid polymeric material and about 20 m/s to about 28 m/s when the optically transmissive window is a porous polymeric material.

The sound waves generated by the electrical signal cause expansion and contraction of the horn (e.g., vibration). The combination of the horn vibration and the actuator pressure creates frictional heat at the interface of the body of the polishing pad and the optically transmissive window. For example, when the body of the polishing pad and the optically transmissive window comprise thermoplastic polymers, the polymers can melt and flow together forming a bond between the polymers of the body of the polishing pad and the optically transmissive window.

During welding, the horn vibrates at a particular vibrational frequency. The vibrational frequency typically is held constant at about 20,000 cycles per second (20 kHz) although any suitable vibrational frequency can be used. The amplitude of the vibrational frequency can be modified such that the amplitude is in the range of about 50% to about 100%, preferably about 80% to about 100%, of the maximum amplitude. The gain of the horn frequency can be varied using a booster. Typically the booster ratio is about 1:1, about 1:1.5, or even about 1:2, wherein the ratio refers to the incoming power relative to the outgoing power.

The horn can be recessed on the welding face so that the horn pressure is concentrated on the outside perimeter (e.g., outside about 0.1 to about 0.5 cm perimeter) of the optically transmissive window. In this way, the welding pressure and ultrasonic energy are concentrated at the interface between the body of the polishing pad and the optically transmissive window.

The horn is vibrated against the surface of the body of the polishing pad and the optically transmissive window for a predetermined period of time, i.e., the weld time. The weld time will depend, at least in part, on the actuator pressure, actuator velocity, the vibrational frequency and the amplitude of the vibrational frequency, as well as the type of materials being welded together. The horn vibration is stopped once the materials begin to melt and flow, which, with thermoplastic materials, generally takes about 1 second or less (e.g., about 0.9 seconds or less). When the optically transmissive window is a solid polymeric material, the weld time is typically about 0.4 seconds to about 0.9 seconds (e.g., about 0.5 seconds to about 0.8 seconds). When the optically transmissive window is a porous polymeric material, the weld time is typically about 0.5 seconds or less (e.g., about 0.2 seconds to about 0.4 seconds). Preferably, the actuator pressure is maintained for a period of time after the horn vibration has stopped so as to allow the materials of the body of the polishing pad and optically transmissive window to fuse together. Once the materials have solidified, the horn and support fixture are removed.

When the body of the polishing pad and the optically transmissive window are positioned adjacent to one another in preparation for ultrasonic welding, desirably a gap is left between the body of the polishing pad and the optically transmissive window. Typically, the gap is about 100 microns or less (e.g., about 75 microns or less), preferably about 50 microns or less (e.g., about 40 microns or less).

The weld time, amplitude, actuator pressure, and actuator velocity are important parameters for controlling the quality of the weld. For example, if the weld time is too short, or if the amplitude, pressure, and velocity are too low, the welded polishing pad may have weak bond strength. If the weld time is too long, or if the amplitude, pressure, and velocity are too high, the welded polishing pad may become distorted, have excess flash (e.g., may have a raised portion of excess material around the edge of where the horn was positioned), or the window may be burned through. Any of these features could render the polishing pad unusable for polishing, for example, the polishing pad could leak around the window, or the polishing pad may create undesirable polishing defects on the substrate.

In some embodiments, it is desirable to pre-treat the polishing pad and/or optically transmissive window to enhance the uniformity and strength of the ultrasonic weld. One such pre-treatment involves exposing the polishing pad and/or optically transmissive window to an electrical discharge (i.e., "corona treatment") to oxidize the surfaces of the polishing pad and/or optically transmissive window.

At least one of the body of the polishing pad and the optically transmissive window comprises a material that is capable of melting and/or flowing under the conditions of the ultrasonic welding process. In some embodiments, both the body of the polishing pad and the optically transmissive window comprise a material that is capable of melting and/or flowing under the conditions of the ultrasonic welding process. Typically, the body of the polishing pad and the optically transmissive window comprise (e.g., consist essentially of, or consist of) a polymer resin. The polymer resin can be any suitable polymer resin. For example, the polymer resin can be selected from the group consisting of thermoplastic elastomers, thermoset polymers (e.g., thermosetting polyurethane), polyurethanes (e.g., thermoplastic polyurethane), polyolefins (e.g., thermoplastic polyolefins), polycarbonates, polyvinylalcohols, nylons, elastomeric rubbers, elastomeric polyethylenes, polytetrafluoroethylene, polyethyleneterephthalate, polyimides, polyaramides, polyarylenes, copolymers thereof, and mixtures thereof. Preferably, the polymer resin is a polyurethane resin.

The body of the polishing pad can have any suitable structure, density, and porosity. The body of the polishing pad can be closed cell (e.g., a porous foam), open cell (e.g., a sintered material), or solid (e.g., cut from a solid polymer sheet). The body of the polishing pad can be formed by any method known in the art. Suitable methods include casting, cutting, reaction injection molding, injection blow molding, compression molding, sintering, thermoforming, or pressing the porous polymer into the desired polishing pad shape. Other polishing pad elements also can be added to the porous polymer before, during, or after shaping the porous polymer, as desired. For example, backing materials can be applied, holes can be drilled, or surface textures can be provided (e.g., grooves, channels), by various methods generally known in the art.

Similarly, the optically transmissive window can have any suitable structure, density, and porosity. For example, the optically transmissive window can be solid or porous (e.g., microporous or nanoporous having an average pore size of less than 1 micron). Preferably, the optically transmissive window is solid or is nearly solid (e.g., has a void volume of about 3% or less).

Preferably, the optically transmissive window comprises a material that is different from the material of the body of the polishing pad. For example, the optically transmissive window can have a different polymer composition than the body of the polishing pad, or the optically transmissive window can comprise a polymer resin that is the same as that of the body of the polishing pad, but having at least one different physical property (e.g., density, porosity, compressibility, or hardness). In one preferred embodiment, the body of the polishing pad comprises a porous polyurethane, and the window comprises a solid polyurethane. In another preferred embodiment, the body of the polishing pad comprises thermoplastic polyurethane and the window comprises thermoset polyurethane. A particularly preferred embodiment involves the use of a thermoplastic polyurethane window (e.g., a solid window), which is welded to a thermoset polyurethane polishing pad body (e.g., a porous polishing pad body). In such an embodiment, the thermoset polyurethane does not tend to melt or flow under the ultrasonic welding conditions, rather the thermoplastic polyurethane window tends to melt and flow into the void spaces (e.g., pore structure) of the thermoset polishing pad body. Of course, both the body of the polishing pad and the optically transmissive window can comprise a material that melts or flows under the same conditions for the ultrasonic welding process. For example, both the polishing pad body and the optically transmissive window can comprise thermoplastic polyurethane.

The polishing pad optionally can comprise organic or inorganic particles. For example, the organic or inorganic particles can be selected from the group consisting of metal oxide particles (e.g., silica particles, alumina particles, ceria particles), diamond particles, glass fibers, carbon fibers, glass beads, aluminosilicates, phyllosilicates (e.g., mica particles), cross-linked polymer particles (e.g., polystyrene particles), water-soluble particles, water-absorbent particles, hollow particles, combinations thereof, and the like. The particles can have any suitable size, for example the particles can have an average particle diameter of about 1 nm to about 10 microns (e.g., about 20 nm to about 5 microns). The amount of the particles in the body of the polishing pad can be any suitable amount, for example, from about 1 wt. % to about 95 wt. % based on the total weight of the polishing pad body.

The optically transmissive window also may comprise, consist essentially of, or consist of an inorganic material. For example, the optically transmissive window can comprise inorganic particles (e.g., metal oxide particles, polymer particles, and the like) or can be an inorganic window comprising an inorganic material such as a quartz or inorganic salt (e.g., KBr), wherein the window is sealed around the perimeter with a polymer resin or with a low melting metal or metal alloy (e.g., a solder or indium o-ring). When the optically transmissive window comprises a low melting polymer or metal/metal alloy around the perimeter of the window, desirably, the body of the polishing pad (or at least the portion of the body around the aperture of the polishing pad) comprises the same material or a similar material.

Figure 2A:
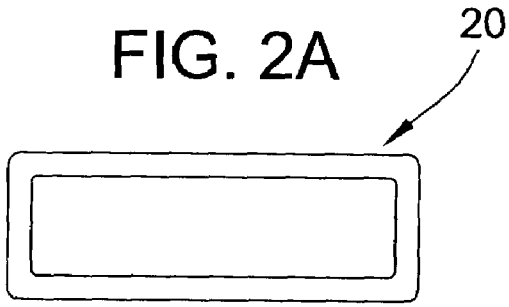
FIG. 2A depicts a top view of a rectangular-shaped optically transmissive window suitable for use in the ultrasonic welding method of the invention.

The optically transmissive window can be of any suitable shape, dimension, or configuration. For example, the optically transmissive window can have the shape of a circle, an oval (as shown in FIG. 1A), a rectangle (as shown in FIG. 2A), a square, or an arc. Preferably, the optically transmissive window is a circle or an oval. When the optically transmissive window is oval or rectangular in shape, the window typically has a length of about 3 cm to about 8 cm (e.g., about 4 cm to about 6 cm) and a width of about 0.5 cm to about 2 cm (e.g., about 1 cm to about 2 cm). When the optically transmissive window is circular or square in shape, the window typically has a diameter (e.g., width) of about 1 cm to about 4 cm (e.g., about 2 cm to about 3 cm). The optically transmissive window typically has a thickness of about 0.1 cm to about 0.4 cm (e.g., about 0.2 cm to about 0.3 cm).

Figure 1B:
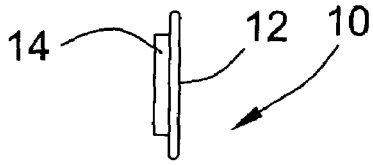
FIG. 1B depicts a side view of the oval-shaped optically transmissive window.
Figure 2B:
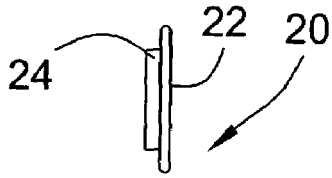
FIG. 2B depicts a side view of the rectangular-shaped optically transmissive window.

Preferably, the optically transmissive window comprises a ledge portion that has a length and/or width that is greater than the length and/or width of the non-ledge portion of the window. The ledge portion can comprise either the top surface or the bottom surface of the optically transmissive window. Preferably, the ledge portion comprises the bottom surface of the optically transmissive window. FIGS. 1B and 2B depict side views of optically transmissive windows (10, 20) comprising a ledge portion (12, 22) and a non-ledge portion (14, 24), respectively. The ledge portion of the optically transmissive window is intended to overlap with the body of the polishing pad (e.g., the top or bottom surface of the body of the polishing pad) so as to provide a better weld between the optically transmissive window and the body of the polishing pad. Typically, the ledge portion of the optically transmissive window has a length and/or width that is about 0.6 cm greater than the length and/or width of the non-ledge portion of the optically transmissive window (i.e., about 0.6 cm greater along the width, length, or diameter). The ledge portion typically has a thickness that is about 50% or less (e.g., about 10% to about 40%, or about 25% to about 35%) of the total thickness of the optically transmissive window.

Figure 3A:
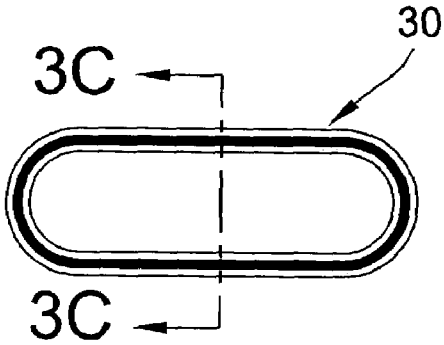
FIG. 3A depicts a top view of an oval-shaped optically transmissive window suitable for use in the ultrasonic welding method of the invention.
Figure 3B:
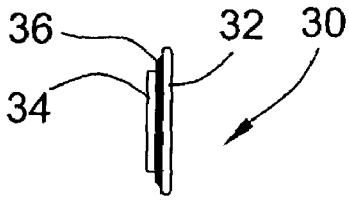
FIG. 3B depicts a side view of the oval-shaped optically transmissive window.
Figure 3C:
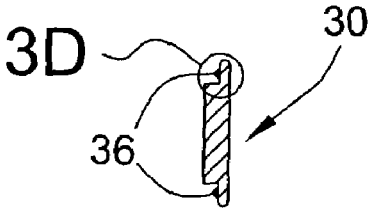
FIG. 3C depicts a cross-sectional view of the oval-shaped optically transmissive window taken along line 3C—3C of FIG. 3A.
Figure 3D:
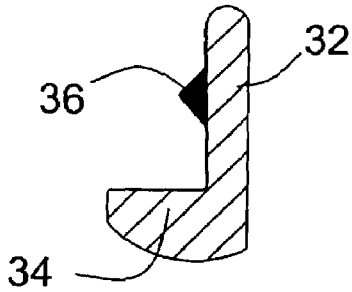
FIG. 3D depicts an enlarged view of the ledge portion, indicated by area 3D of FIG. 3C, of the oval-shaped optically transmissive window highlighting the presence of an energy director on the ledge of the window.

Optionally, the ledge portion of the optically transmissive window further comprises an energy director, such as a raised portion along the periphery of the ledge portion. The energy director typically has a height (extending from the surface of the ledge portion) of about 0.02 cm to about 0.01 cm. Preferably, the energy director is triangular in shape and forms an angle with the surface of the ledge portion of about 120° to about 160° (e.g., about 130° to about 150°). An oval-shaped optically transmissive window (30) having a ledge portion (32), a non-ledge portion (34), and an energy director (36) is shown in FIGS. 3A and 3B. A cross-sectional view of the optically transmissive window (30) is shown in FIG. 3C, and an enlargement of a portion of the ledge portion (32) of the optically transmissive window (30) highlighting the presence of the energy director (36) is shown in FIG. 3D. The energy director is intended to melt quickly during the ultrasonic welding process so as to form a pool of melted polymer that aids in bonding of the optically transparent window to the body of the polishing pad.

The polishing pad can comprise one or more optically transmissive windows. The optically transmissive window can be positioned in any suitable location of the polishing pad. The top surface of the optically transmissive window can be coplanar with the polishing surface of the polishing pad (i.e., the top of the polishing pad intended to contact a workpiece during the polishing of the workpiece) or can be recessed from the polishing surface of the polishing pad.

In some embodiments, the body of the polishing pad is a multi-layer body comprising a top pad and a bottom pad (i.e., a "subpad"). The multi-layer body can be constructed such that the size of the aperture in the top pad is different from the size of the aperture in the bottom pad. For example, the size of the aperture in the top pad can be larger than the size of the aperture in the bottom pad, or alternatively, the size of the aperture in the top pad can be smaller than the size of the aperture in the bottom pad. Using apertures of different sizes creates a pad ledge on either the top pad or bottom pad, which can be welded to an overlapping portion of the optically transmissive window, in particular a ledge portion of the optically transmissive window as described above. In one embodiment, the optically transmissive window is welded to the top pad of the multi-layer body. In another embodiment, the optically transmissive window is welded to the bottom pad of the multi-layer body.

The optically transmissive window can be welded to the body of the polishing pad at any suitable point and with any suitable configuration. For example, the optically transmissive window can be welded to the top surface of the body (e.g., multi-layer body) of the polishing pad such that the top surface of the optically transmissive window is flush with the polishing surface of the polishing pad. Alternatively, the optically transmissive window can be welded to the bottom surface of the body (e.g., multi-layer body) of the polishing pad, or to the bottom surface of the top pad and/or the top surface of the bottom pad of a multi-layer body, such that the top surface of the optically transmissive window is recessed from the polishing surface of the polishing pad.

In addition to the features discussed herein, the body of the polishing pad, optically transmissive window, or other parts of the polishing pad can comprise other elements, ingredients, or additives, such as backings, adhesives, abrasives, and other additives known in the art. The optically transmissive window of the polishing pad can comprise, for example, a light absorbing or reflecting element, such as an ultra-violet or color adsorbing or reflecting material, that enables the passage of certain wavelengths of light, while retarding or eliminating the passage of other wavelengths of light.

A polishing pad produced by the inventive method has a polishing surface which optionally further comprises grooves, channels, and/or perforations which facilitate the lateral transport of a polishing composition across the surface of the polishing pad. Such grooves, channels, or perforations can be in any suitable pattern and can have any suitable depth and width. The polishing pad can have two or more different groove patterns, for example a combination of large grooves and small grooves as described in U.S. Pat. No. 5,489,233. The grooves can be in the form of slanted grooves, concentric grooves, spiral or circular grooves, XY crosshatch pattern, and can be continuous or non-continuous in connectivity. Preferably, the polishing pad has a polishing surface that comprises at least small grooves produced by standard pad conditioning methods.

A polishing pad produced by the inventive method can comprise, in addition to the optically transmissive window, one or more other features or components. For example, the polishing pad optionally can comprise regions of differing density, hardness, porosity, and chemical compositions. The polishing pad optionally can comprise solid particles including abrasive particles (e.g., metal oxide particles), polymer particles, water-soluble particles, water-absorbent particles, hollow particles, and the like.

A polishing pad produced by the inventive method is particularly suited for use in conjunction with a chemical-mechanical polishing (CMP) apparatus. Typically, the apparatus comprises a platen, which, when in use, is in motion and has a velocity that results from orbital, linear, or circular motion, a polishing pad of the invention in contact with the platen and moving with the platen when in motion, and a carrier that holds a workpiece to be polished by contacting and moving relative to the surface of the polishing pad. The polishing of the workpiece takes place by the workpiece being placed in contact with the polishing pad and then the polishing pad moving relative to the workpiece, typically with a polishing composition therebetween, so as to abrade at least a portion of the workpiece to polish the workpiece. The polishing composition typically comprises a liquid carrier (e.g., an aqueous carrier), a pH adjustor, and optionally an abrasive. Depending on the type of workpiece being polished, the polishing composition optionally may further comprise oxidizing agents, organic acids, complexing agents, pH buffers, surfactants, corrosion inhibitors, anti-foaming agents, and the like. The CMP apparatus can be any suitable CMP apparatus, many of which are known in the art. Polishing pads produced by the inventive method also can be used with linear polishing tools.

A polishing pad produced by the inventive method can be used alone or optionally can be used as one layer of a multi-layer stacked polishing pad. For example, the polishing pad can be used in combination with a subpad. The subpad can be any suitable subpad. Suitable subpads include polyurethane foam subpads, impregnated felt subpads, microporous polyurethane subpads, or sintered urethane subpads. The subpad typically is softer than the polishing pad of the invention and therefore is more compressible and has a lower Shore hardness value than the polishing pad. For example, the subpad can have a Shore A hardness of about 35 to about 50. In some embodiments, the subpad is harder, is less compressible, and has a higher Shore hardness than the polishing pad. The subpad optionally comprises grooves, channels, hollow sections, windows, apertures, and the like. When the polishing pad of the invention is used in combination with a subpad, typically there is an intermediate backing layer such as a polyethyleneterephthalate film, coextensive with and between the polishing pad and the subpad.

Polishing pads produced by the inventive method are suitable for use in polishing many types of workpieces (e.g., substrates or wafers) and workpiece materials. For example, the polishing pads can be used to polish workpieces including memory storage devices, glass substrates, memory or rigid disks, metals (e.g., noble metals), magnetic heads, inter-layer dielectric (ILD) layers, polymeric films, low and high dielectric constant films, ferroelectrics, micro-electro-mechanical systems (MEMS), semiconductor wafers, field emission displays, and other microelectronic substrates, especially microelectronic substrates comprising insulating layers (e.g., metal oxide, silicon nitride, or low dielectric materials) and/or metal-containing layers (e.g., copper, tantalum, tungsten, aluminum, nickel, titanium, platinum, ruthenium, rhodium, iridium, alloys thereof, and mixtures thereof). The term "memory or rigid disk" refers to any magnetic disk, hard disk, rigid disk, or memory disk for retaining information in electromagnetic form. Memory or rigid disks typically have a surface that comprises nickel-phosphorus, but the surface can comprise any other suitable material. Suitable metal oxide insulating layers include, for example, alumina, silica, titania, ceria, zirconia, germania, magnesia, and combinations thereof. In addition, the workpiece can comprise, consist essentially of, or consist of any suitable metal composite. Suitable metal composites include, for example, metal nitrides (e.g., tantalum nitride, titanium nitride, and tungsten nitride), metal carbides (e.g., silicon carbide and tungsten carbide), nickel-phosphorus, alumino-borosilicate, borosilicate glass, phosphosilicate glass (PSG), borophosphosilicate glass (BPSG), silicon/germanium alloys, and silicon/germanium/carbon alloys. The workpiece also can comprise, consist essentially of, or consist of any suitable semiconductor base material. Suitable semiconductor base materials include single-crystal silicon, poly-crystalline silicon, amorphous silicon, silicon-on-insulator, and gallium arsenide.

EXAMPLE

This example further illustrates the invention but, of course, should not be construed as in any way limiting its scope. This example demonstrates the inventive method for producing a polishing pad comprising an optically transmissive window using ultrasonic welding.

Different combinations of optically transmissive windows and polishing pads were ultrasonically welded with a horn under different welding conditions (Samples A–F). The polishing pads each comprised a body with an aperture into which the optically transmissive window was welded. Samples A–C consisted of oval-shaped sintered porous thermoplastic polyurethane (TPU) windows that were welded into a sintered porous TPU body of a polishing pad, a solid TPU body of a polishing pad, or a closed-cell thermosetting polyurethane body of a polishing pad, respectively. Samples D and E consisted of solid TPU windows having an oval and rectangular shape, respectively, that were welded into a closed-cell thermosetting polyurethane body of a polishing pad. Sample F consisted of a circular sintered porous TPU window that was welded into a closed-cell thermosetting polyurethane body of a polishing pad. The horn frequency was 20 kHz with a maximum power output of 2000 watts. The amplitude of the horn frequency was modulated as a percent of the maximum amplitude, and the gain of the horn frequency was modulated using a booster ratio of either 1:1 or 1:1.5. The horn was fixed in place against the surface of the body of the polishing pad and the window at a particular actuator pressure and actuator velocity. The values for the horn amplitude, booster ratio, actuator pressure and velocity, and weld time for each of the polishing pad weld samples are summarized in the table below.

| Sample | A | B | C | D | E | F |
|---|---|---|---|---|---|---|
| Pad Body Type | Sintered Porous TPU | Solid TPU | Closed Cell Thermoset | Closed Cell Thermoset | Closed Cell Thermoset | Closed Cell Thermoset |
| Window Shape | oval | oval | oval | oval | rectangle | circle |
| Window Type | Sintered Porous TPU | Sintered Porous TPU | Sintered Porous TPU | Solid TPU | Solid TPU | Sintered Porous TPU |
| Horn Amplitude | 80% | 90% | 100% | 100% | 100% | 80% |
| Booster Ratio | 1:1 | 1:1.5 | 1:1 | 1:1.5 | 1:1.5 | 1:1 |
| Actuator Pressure (MPa) | 0.207 | 0.262 | 0.241 | 0.276 | 0.345 | 0.172 |
| Actuator Velocity (m/s) | 22.86 | 27.432 | 25.908 | 30.48 | 30.48 | 22.86 |
| Weld Time (s) | 0.35 | 0.40 | 0.30 | 0.80 | 0.80 | 0.30 |

Each of the Samples A–F produced welded polishing pads having good bond strength between the body of the polishing pad and the optically transmissive window with no flash or distortion of the polishing pad. This example shows that ultrasonic welding can be a useful technique for producing polishing pads with optically transmissive regions without the need for an adhesive.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A method of forming a chemical-mechanical polishing pad having at least one optically transmissive region comprising:

(i) providing a polishing pad with a body comprising an aperture, (ii) inserting an optically transmissive window into the aperture of the body of the polishing pad, and (iii) bonding the optically transmissive window to the body of the polishing pad by ultrasonic welding to form a polishing pad having the optically transmissive window; wherein (a) the body of the polishing pad comprises a thermosetting polymer resin and the optically transmissive window comprises a thermoplastic polymer resin or (b) the body of the polishing pad comprises a thermoplastic polymer resin and the optically transmissive window comprises a thermosetting polymer resin.

2. The method of claim 1, wherein the polymer resin is selected from the group consisting of thermoplastic elastomers, thermoset polymers, polyurethanes, polyolefins, polycarbonates, polyvinylalcohols, nylons, elastomeric rubbers, elastomeric polyethylenes, polytetrafluoroethylene, polyethyleneterephthalate, polyimides, polyaramides, polyarylenes, copolymers thereof, and mixtures thereof.

3. The method of claim 2, wherein the optically transmissive window comprises thermoplastic polyurethane.

4. The method of claim 1, wherein the body of the polishing pad is a sintered polishing pad, a solid polishing pad, or a porous foam polishing pad.

5. The method of claim 1, wherein the body of the polishing pad and the optically transmissive window each comprise a different polymer resin.

6. The method of claim 5, wherein the body of the polishing pad comprises a thermosetting polymer resin and the optically transmissive window comprises a thermoplastic polymer resin.

7. The method of claim 6, wherein the body of the polishing pad comprises a thermosetting polyurethane resin and the optically transmissive window comprises a thermoplastic polyurethane resin.

8. The method of claim 1, wherein the body of the polishing pad is porous and the optically transmissive window is solid.

9. The method of claim 5, wherein the body of the polishing pad comprises a thermoplastic polymer resin and the optically transmissive window comprises a thermosetting polymer resin.

10. The method of claim 1, wherein the body of the polishing pad is a multilayer body comprising a top pad and a bottom pad.

11. The method of claim 10, wherein the optically transmissive window is welded to the top pad of the multilayer body of the polishing pad.

12. The method of claim 1, wherein the optically transmissive window has the shape of an oval or a circle.

13. The method of claim 1, wherein the bonding step involves the use of a weld time of about 1 second or less.

14. The method of claim 1, wherein the bonding step involves the use of an actuator pressure of about 0.2 MPa to about 0.45 MPa.

15. The method of claim 1, wherein the optically transmissive window comprises a ledge portion and a non-ledge portion.

16. The method of claim 15, wherein the optically transmissive window further comprises an energy director.

17. A chemical-mechanical polishing pad having at least one optically transmissive region produced by the method of claim 1.

18. A chemical-mechanical polishing pad having at least one optically transmissive region produced by the method of claim 8.

* * * * *